US010496019B2

(12) United States Patent
Kasama

(10) Patent No.: US 10,496,019 B2
(45) Date of Patent: Dec. 3, 2019

(54) IMAGE FORMING APPARATUS

(71) Applicant: CANON KABUSHIKI KAISHA, Tokyo (JP)

(72) Inventor: Hiroki Kasama, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/137,161

(22) Filed: Sep. 20, 2018

(65) Prior Publication Data

US 2019/0137912 A1 May 9, 2019

(30) Foreign Application Priority Data

Nov. 6, 2017 (JP) ..... 2017-214158

(51) Int. Cl.

| | |
|---|---|
| ***G03G 15/20*** | (2006.01) |
| ***G03G 15/08*** | (2006.01) |
| ***G03G 15/00*** | (2006.01) |
| ***G03G 21/16*** | (2006.01) |
| *G03G 21/20* | (2006.01) |

(52) U.S. Cl.

CPC ..... *G03G 15/2028* (2013.01); *G03G 15/0808* (2013.01); *G03G 15/6529* (2013.01); *G03G 21/1633* (2013.01); *G03G 15/6502* (2013.01); *G03G 21/206* (2013.01); *G03G 2215/00544* (2013.01)

(58) Field of Classification Search

USPC ..... 399/322

See application file for complete search history.

(56) References Cited

U.S. PATENT DOCUMENTS

| | | | | |
|---|---|---|---|---|
| 5,508,477 A * | 4/1996 | Kato | G10K 11/172 181/205 |
| 2008/0078611 A1* | 4/2008 | Inoue | G06F 1/181 181/206 |
| 2015/0243274 A1* | 8/2015 | Hirakawa | G03G 21/00 399/91 |
| 2016/0033928 A1* | 2/2016 | Ishimitsu | G03G 21/1633 399/91 |

FOREIGN PATENT DOCUMENTS

JP 2015169864 A 9/2015

* cited by examiner

*Primary Examiner* — Quana Grainger
(74) *Attorney, Agent, or Firm* — Canon U.S.A., Inc. IP Division

(57) ABSTRACT

An image forming apparatus includes a conveyance path, an image forming unit, an opening/closing member, a facing member, a first member, and a second member. The conveyance path conveys a sheet. The image forming unit forms an image on a sheet conveyed along the conveyance path. The opening/closing member is openable and closable with respect to an apparatus main body. A part of the conveyance path is exposed in a case where the opening/closing member is opened. Where the opening/closing member is closed with respect to the apparatus main body, the facing member is provided on a position facing the opening/closing member. The first member is provided in the opening/closing member. The second member is provided in the facing member. Where the opening/closing member is closed by a fixing member with respect to the apparatus main body, the first member and the second member form a Helmholtz resonator.

10 Claims, 15 Drawing Sheets

IMAGE FORMING APPARATUS

BACKGROUND OF THE INVENTION

Field of the Invention

The present disclosure relates to an image forming apparatus including a Helmholtz resonator.

Description of the Related Art

Image forming apparatuses such as copying machines and printers generate operation sounds caused by operation of motors, fans, and the like when forming images. Recently, there is a strong demand for silencing of image forming apparatuses. As a configuration for reducing an operation sound of an image forming apparatus, an image forming apparatus equipped with a Helmholtz resonator is discussed (Japanese Patent Application Laid-Open No. 2015-169864).

The Helmholtz resonator according to Japanese Patent Application Laid-Open No. 2015-169864 is constituted of two components, namely a sound absorption body member and a sound absorbing cover member in such a way that these two components sandwich a sealing member therebetween and are fixed by cover fixing screws.

SUMMARY OF THE INVENTION

According to an aspect of the present disclosure, an image forming apparatus includes a conveyance path configured to convey a sheet, an image forming unit configured to form an image on a sheet conveyed along the conveyance path, an opening/closing member configured to be openable and closable with respect to an apparatus main body, wherein a part of the conveyance path is exposed in a case where the opening/closing member is opened, a facing member, wherein, in a case where the opening/closing member is closed with respect to the apparatus main body, the facing member is provided on a position facing the opening/closing member, a first member provided in the opening/closing member, and a second member provided in the facing member, wherein, in a case where the opening/closing member is closed by a fixing member with respect to the apparatus main body, the first member and the second member form a Helmholtz resonator.

According to the present disclosure, an image forming apparatus including a Helmholtz resonator constituted of two components reduces a sound generated from the image forming apparatus without greatly increasing costs.

Further features of the present disclosure will become apparent from the following description of embodiments with reference to the attached drawings.

DESCRIPTION OF THE EMBODIMENTS

Various embodiments of the present disclosure will be described in detail below with reference to the attached drawings. It is noted that the embodiments described below are not meant to limit the scope of the present disclosure as encompassed by the appended claims, and a configuration including an electrophotographic type process is only described as an example in an image forming apparatus described below.

A first embodiment of the present disclosure is described with reference to FIGS. 1 to 12.

[Configuration and Operation of Image Forming Apparatus]

Figure 2:
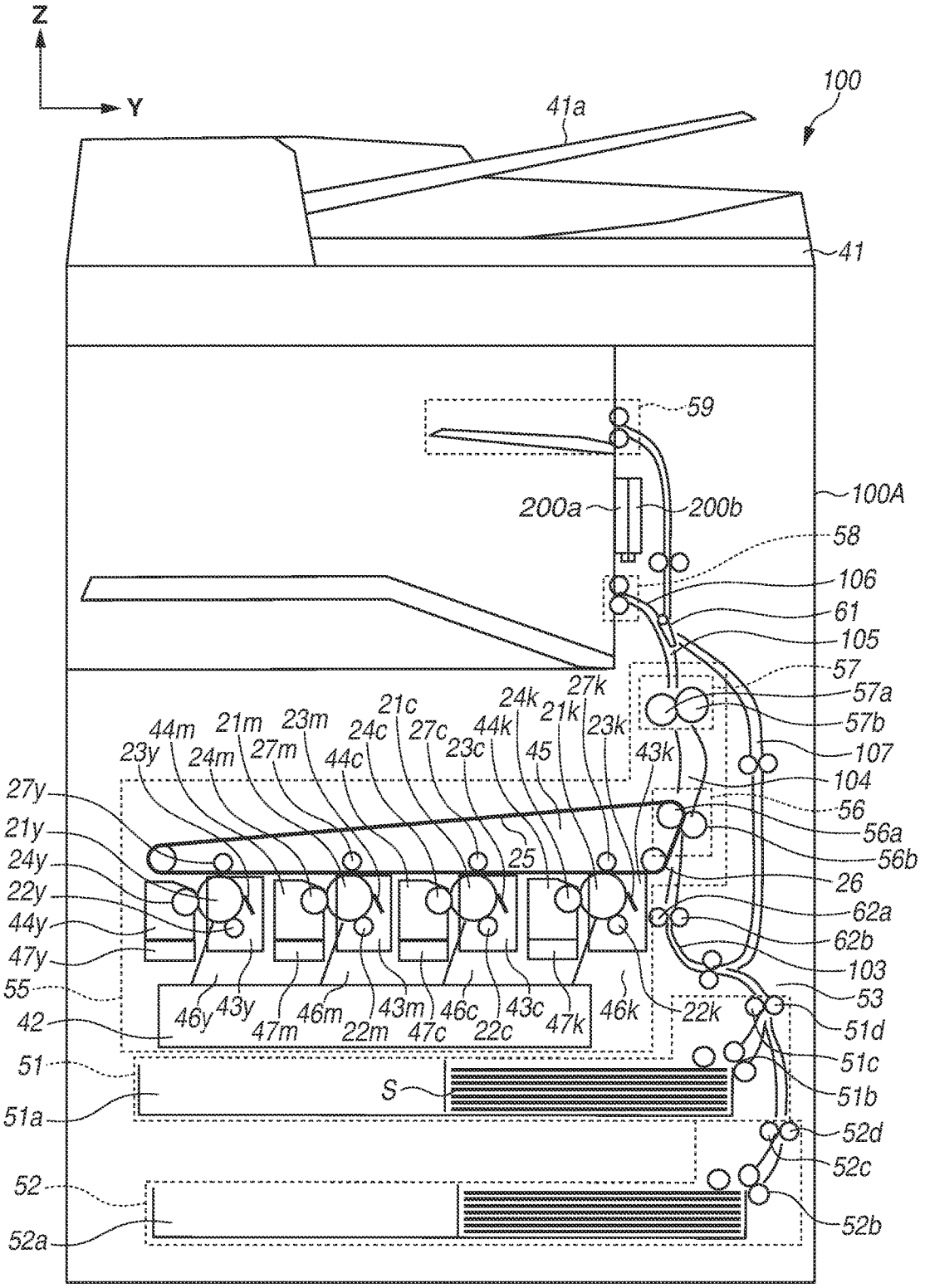
FIG. 2 is a schematic configuration view of an image forming apparatus including the Helmholtz resonator according to the first embodiment.

FIG. 2 illustrates a schematic configuration of an image forming apparatus according to the first embodiment of the present disclosure.

In FIG. 2, an image forming apparatus 100 includes an image forming apparatus main body 100A (hereinbelow, referred to as the apparatus main body) and an image reading unit 41 provided on an upper part of the apparatus main body 100A. The image reading unit 41 includes an image sensor which illuminates a document placed on a platen glass as a document positioning plate with light and converts reflected light therefrom into a digital signal. A document of which an image is read is conveyed onto the platen glass by an automatic document feeding device 41*a*. The apparatus main body 100A includes an image forming unit 55, sheet feeding devices 51 and 52 for feeding a sheet S to the image forming unit 55, and a sheet reversing unit 59 for reversing and conveying the sheet S to the image forming unit 55.

The image forming unit 55 includes image forming units for forming four color toner images of yellow (Y), magenta (M), cyan (C), and black (Bk). In the following description, when components of the respective image forming units are distinguished, suffixes y, m, c, and k are attached to ends of reference numerals. When the components are not distinguished, the suffixes y, m, c, and k are omitted.

The image forming unit 55 includes an exposure unit 42, four photosensitive drum cartridges 43 (43*y*, 43*m*, 43*c*, and 43*k*), and four development cartridges 44 (44*y*, 44*m*, 44*c*, and 44*k*). The image forming unit 55 further includes an intermediate transfer unit 45, a secondary transfer unit 56, and a fixing unit 57 which are arranged above the photosensitive drum cartridges 43 and the development cartridges 44.

The photosensitive drum cartridges 43 respectively include photosensitive drums 21 (21*y*, 21*m*, 21*c*, and 21*k*), charging rollers 22 (22*y*, 22*m*, 22*c*, and 22*k*), and drum cleaning blades 23 (23*y*, 23*m*, 23*c*, and 23*k*). The photosensitive drums 21 are configured to be rotatable in a clockwise direction in FIG. 2. The photosensitive drum cartridges 43 are configured to be detachable from the apparatus main body 100A. The photosensitive drum cartridges 43 are supported inside the apparatus main body 100A by drum cartridge support members 46 (46*y*, 46*m*, 46*c*, and 46*k*) included in the apparatus main body 100A. The photosensitive drum cartridges 43 can be withdrawn to a front direction of a sheet surface of FIG. 2 and can be attached to a depth direction of the sheet surface of FIG. 2.

When air passes over or in a cavity, the passing air may cause the cavity to oscillate with increased amplitude at specific frequencies. The phenomenon, called Helmholtz resonance, may also be indicted by a vibrating system or force external applied to the cavity. In the image forming unit 55 according to the present embodiment, a Helmholtz resonator 200 is constituted of the photosensitive drum cartridges 43 and the drum cartridge support members 46. The configuration is described in detail below.

The development cartridges 44 respectively include developing rollers 24 (24*y*, 24*m*, 24*c*, and 24*k*). The development cartridges 44 are configured to be insertable into and drawable from the apparatus main body 100A and respectively supported by development cartridge support members 47 (47*y*, 47*m*, 47*c*, and 47*k*) included in the apparatus main body 100A.

The intermediate transfer unit 45 includes an intermediate transfer belt 25 stretched around a belt drive roller 26, a secondary transfer inner roller 56*a*, and the like and primary transfer rollers 27 (27*y*, 27*m*, 27*c*, and 27*k*) abutting on the intermediate transfer belt 25 at positions facing the respective photosensitive drums 21. The primary transfer rollers 27 apply transfer biases having a positive polarity to the intermediate transfer belt 25 as described below, and thus toner images having a negative polarity on the photosensitive drums 21 are sequentially and multiply transferred to the intermediate transfer belt 25. Accordingly, a full-color image is formed on the intermediate transfer belt 25.

The secondary transfer unit 56 is constituted of the secondary transfer inner roller 56*a* and a secondary transfer outer roller 56*b* which is in contact with the secondary transfer inner roller 56*a* via the intermediate transfer belt 25. The secondary transfer outer roller 56*b* is applied with a secondary transfer bias having a positive polarity as described below, and thus the full-color image formed on the intermediate transfer belt 25 is transferred to the sheet S.

The fixing unit 57 includes a fixing roller 57*a* and a fixing backup roller 57*b*. The sheet S is nipped and conveyed between the fixing roller 57*a* and the fixing backup roller 57*b*, and thus the toner image on the sheet S is pressed, heated, and fixed on the sheet S.

The sheet feeding devices 51 and 52 respectively include cassettes 51*a* and 52*a* as storage units for storing the sheets S. Further, the sheet feeding devices 51 and 52 respectively include sheet separation feeding units 51*b* and 52*b* having a function of separating the sheets S stored in the cassettes 51*a* and 52*a* by frictional force and feeding the sheet S one by one.

In FIG. 2, a pre-secondary transfer conveyance path 103 is a path for conveying the sheet S fed from the cassette 51*a* or 52*a* up to the secondary transfer unit 56. A pre-fixation conveyance path 104 is a path for conveying the sheet S conveyed up to the secondary transfer unit 56 from the secondary transfer unit 56 up to the fixing unit 57. A post-fixation conveyance path 105 is a path for conveying the sheet S conveyed up to the fixing unit 57 from the fixing unit 57 up to a switching member 61. A sheet discharge path 106 is a path for conveying the sheet S conveyed up to the switching member 61 from the switching member 61 up to a sheet discharge unit 58. A refeeding path 107 is a path for conveying the sheet S reversed by the sheet reversing unit 59 again to the image forming unit 55 so as to form an image on a back surface of the sheet S which has an image formed by the image forming unit 55 on one surface.

Next, an image forming operation of the image forming apparatus 100 having the above-described configuration is described. When an image forming operation is started, the exposure unit 42 first irradiates surfaces of the photosensitive drums 21 with laser beams based on image information from a personal computer (not illustrated) and the like. At that time, the surfaces of the photosensitive drums 21 are uniformly charged to predetermined polarity and potential by the charging rollers 22, and when being irradiated with the laser beams, the charges of portions irradiated with the laser beams are attenuated, so that electrostatic latent images are formed on the photosensitive drum surfaces.

Subsequently, the developing rollers 24 are applied with a predetermined potential and respectively supply yellow (Y), magenta (M), cyan (C), and black (Bk) toners, so that the electrostatic latent images are developed as toner images. The toner images of respective colors are sequentially transferred to the intermediate transfer belt 25 by primary transfer biases applied to the respective primary transfer rollers 27, and thus a full-color toner image is formed on the intermediate transfer belt 25.

On the other hand, in parallel with the toner image forming operation, the sheet feeding device 51 or 52 separates and feeds only one of the sheets S from the cassette 51*a* or 52*a* by the sheet separation feeding unit 51*b* or 52*b*. The sheet S then reaches a pair of drawing rollers 51*c* and 51*d*. Further, the sheet S nipped by the pair of drawing rollers 51*c* and 51*d* is conveyed to the pre-secondary transfer conveyance path 103 after sheet thickness detection by a sheet thickness detection unit 53 and abuts on a pair of registration rollers 62*a* and 62*h* which are stopped, so that a leading edge position of the sheet S is adjusted.

Next, the pair of registration rollers 62*a* and 62*b* is driven at a timing when positions of the full-color toner image on the intermediate transfer belt and the sheet S are matched with each other in the secondary transfer unit 56. Thus, the sheet S is conveyed to the secondary transfer unit 56, and the full-color toner image is collectively transferred to the sheet S by a secondary transfer bias applied to the secondary transfer outer roller 56*b* at the secondary transfer unit 56.

The sheet S on which the full-color toner image is transferred is conveyed to the fixing unit 57 and applied with heat and pressure at the fixing unit 57, so that the respective color toners are melted, mixed, and fixed as the full-color image on the sheet S. Subsequently, the sheet S on which the image is fixed is discharged by the sheet discharge unit 58 disposed downstream of the fixing unit 57, When images are formed on both sides of the sheet S, a conveyance direction of the sheet S is reversed by the sheet reversing unit 59, and the sheet S is conveyed again to the image forming unit 55.

Figure 15:
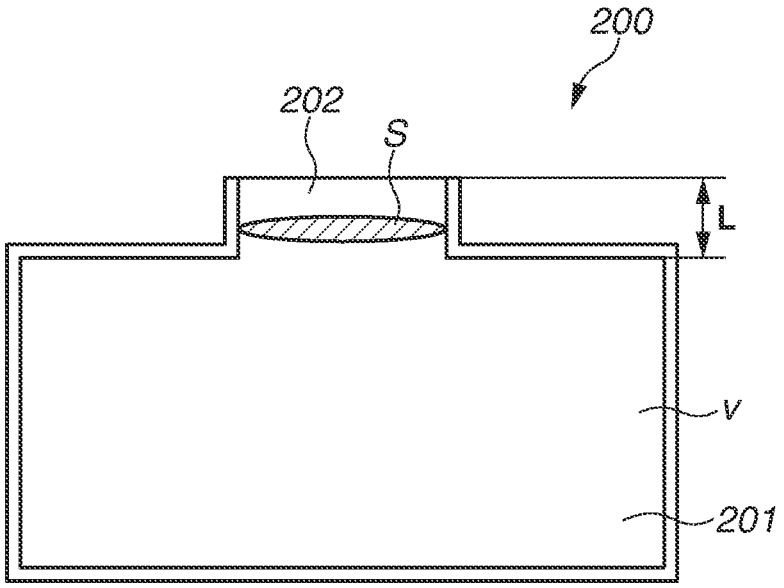
FIG. 15 is a schematic diagram of a Helmholtz resonator.

Next, a structure of the Helmholtz resonator 200 included in the image forming apparatus 100 of the present disclosure is described with reference to FIG. 15, FIG. 15 is a schematic diagram of the Helmholtz resonator 200.

The Helmholtz resonator 200 roughly includes a cavity portion 201 having a space of volume V and a communication portion 202 having a length L extended from the cavity portion 201 and an opening having a cross sectional area S. A mass of air in the communication portion 202 is vibrated by an air spring formed by the space in the cavity portion 201 and resonates, so that a specific frequency f of a sound entering the communication portion 202 is silenced. The specific frequency f to be silenced is expressed by a formula (1).

[Formula 1]

$$f = \frac{c}{2\pi}\sqrt{\frac{S}{V(L+\Delta L)}} \tag{1}$$

In the formula (1), "c" represents the speed of sound, and ΔL which represents an opening end correction is 1.6a ("a" is a radius when the cross section of the communication portion 202 is regarded as a circle).

Thus, the parameters of the Helmholtz resonator 200 are determined so that a frequency of a sound to be silenced is matched with the specific frequency f of the formula (1).

Next, the first embodiment of the present disclosure is described with reference to FIGS. 1 and 3 to 12. The first embodiment of a silencing device which is a main part is described.

The Helmholtz resonator 200 according to the present embodiment includes two components, namely a Helmholtz member 200*a* as an example of a first Helmholtz portion and a Helmholtz member 200*b* as an example of a second Helmholtz portion.

Figure 3A:
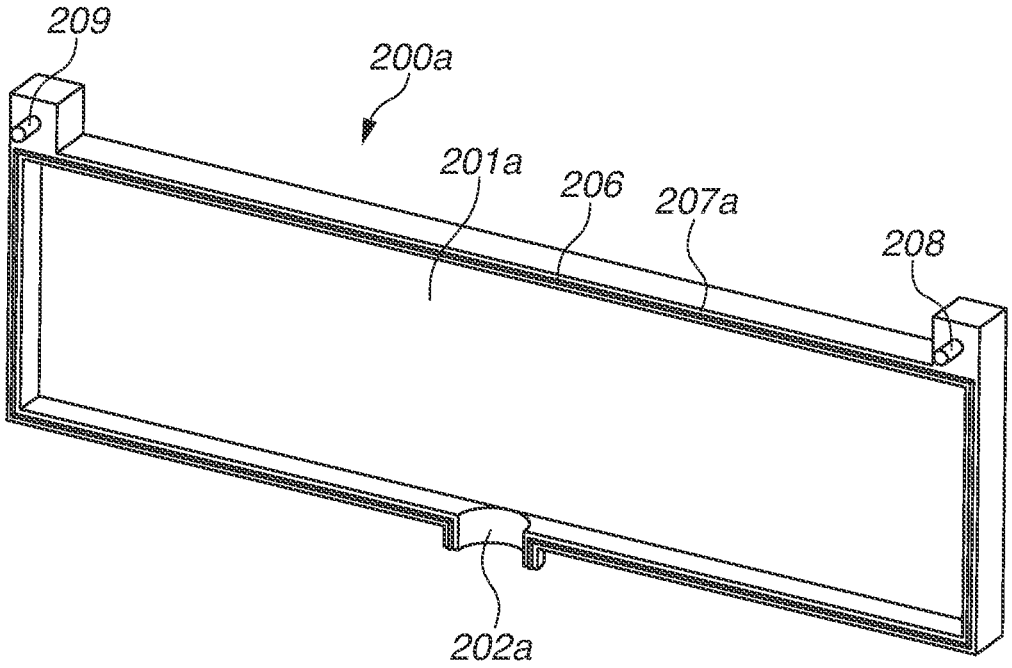
FIG. 3A is an entire perspective view of a Helmholtz member according to the first embodiment.
Figure 3B:
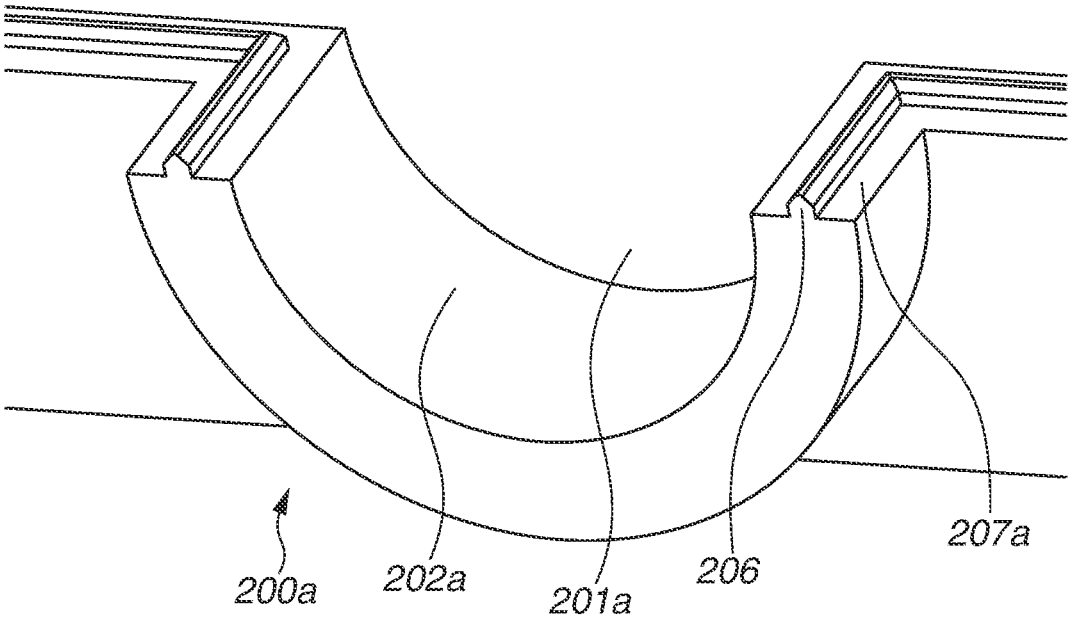
FIG. 3B is an enlarged perspective view of a main part of the Helmholtz member according to the first embodiment.

FIG. 3A is a perspective view of the Helmholtz member 200*a* constituting the Helmholtz resonator 200. FIG. 3B is an enlarged view of a communication portion 202*a*. The Helmholtz member 200*a* surrounds the cavity portion 201*a* and a communication portion 202*a* with a pressing portion 206 as an example of a contact portion except a part of the communication portion 202*a*. As illustrated in FIG. 3B, the pressing portion 206 has a shape protruding from an abutting portion 207*a*. A leading edge of the pressing portion 206 is not a sharp shape but a small rounded shape with a radius of 0.1 mm. As illustrated in FIG. 3A, the Helmholtz member 200*a* includes a left positioning portion 208 and a right positioning portion 209 having an extrusion pin shape for constituting the Helmholtz resonator 200.

Figure 4A:
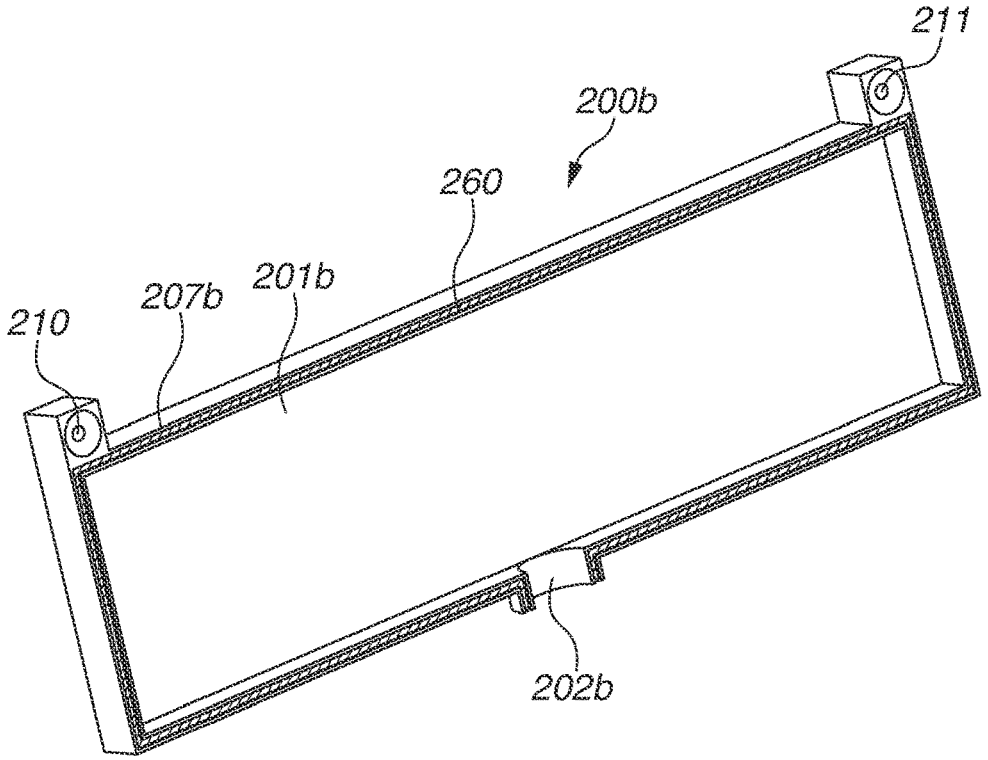
FIG. 4A is an entire perspective view of a Helmholtz member according to the first embodiment.
Figure 4B:
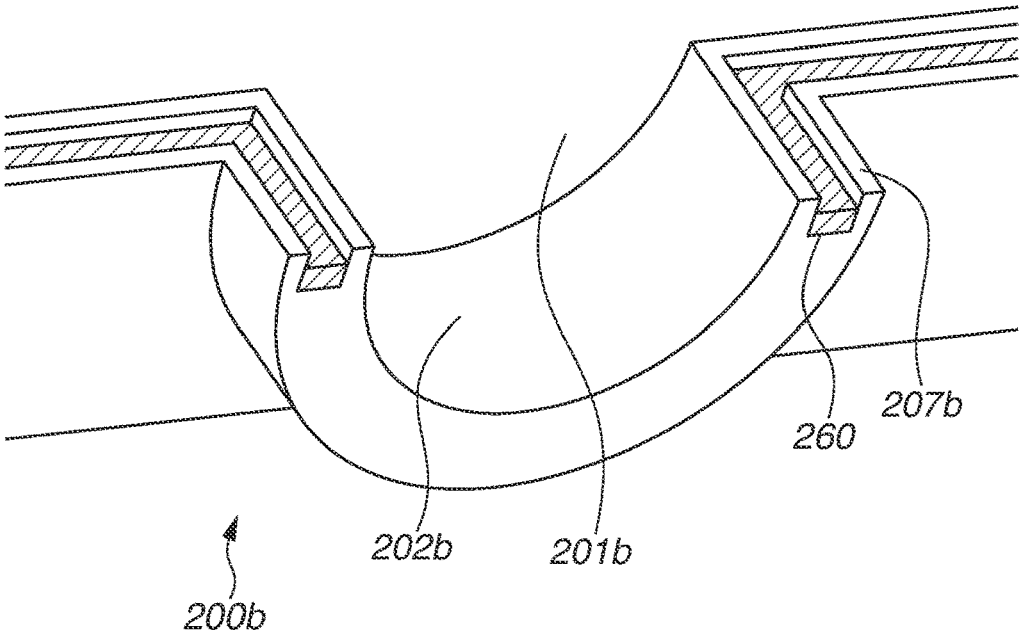
FIG. 4B is an enlarged perspective view of a main part of the Helmholtz member according to the first embodiment.

FIG. 4A is a perspective view of the Helmholtz member 200*b* constituting the Helmholtz resonator 200. FIG. 4B is an enlarged view of a communication portion 202*b*. The Helmholtz member 200*b* includes a groove for surrounding a cavity portion 201*b* and the communication portion 202*b* except a part of the communication portion 202*b*. A sealing member 260 which is a rubber member is fixed with a double-sided adhesive tape inside the groove so as not to protrude from the groove. The sealing member 260 is not limited to the rubber member and may be a porous substance such as a sponge and another elastic member as long as the member does not communicate air when being compressed. In addition, the fixing method is not limited to the double-sided adhesive tape and may use an adhesive and the like. As illustrated in FIG. 4A, the Helmholtz member 200*b* includes a left positioning hole 210 and a right positioning hole 211.

The left positioning portion 208 and the right positioning portion 209 of the Helmholtz member 200*a* are respectively inserted into the left positioning hole 210 and the right positioning hole 211 of the Helmholtz member 200*b*. Further, the abutting portion 207*a* of the Helmholtz member 200*a* is brought into contact with an abutting portion 207*b* of the Helmholtz member 200*b*. The Helmholtz member 200*a* and the Helmholtz member 200*b* are thus fixed in contact with each other, and the Helmholtz resonator 200 is formed. A circumference of the left positioning hole 210 has a mortar shape so as to guide the left positioning portion 208 to the left positioning hole 210. Similarly, a circumference of the right positioning hole 211 has a mortar shape so as to guide the right positioning portion 209 to the right positioning hole 211. In the above-described contact fixation, the sealing member 260 of the Helmholtz member 200*b* is in close contact with and pushed by the pressing portion 206 of the Helmholtz member 200*a*. In addition, a cavity portion 201 of the Helmholtz resonator 200 is formed by the cavity portion 201*a* of the Helmholtz member 200*a* and the cavity portion 201*b* of the Helmholtz member 200*b* in the contact fixation. Similarly, a communication portion 202 of the Helmholtz resonator 200 is formed by the communication portion 202*a* of the Helmholtz member 200*a* and the communication portion 202*b* of the Helmholtz member 200*b*. According to the present embodiment, the pressing portion 206 is provided in the Helmholtz member 200*a*, and the sealing member 260 is provided in the Helmholtz member 200*b*, however, the configuration is not limited to this. The pressing portion 206 may be provided in one of the Helmholtz member 200*a* and the Helmholtz member 200*b*, and the sealing member 260 may be provided in the other.

Generally, the Helmholtz resonator 200 is manufactured by molding using a resin material. Neck portions forming the communication portions 202*a* and 202*b* of the Helmholtz members 200*a* and 200*b* respectively have semicylinder shapes from a point of view of resin moldability.

Figure 5A:
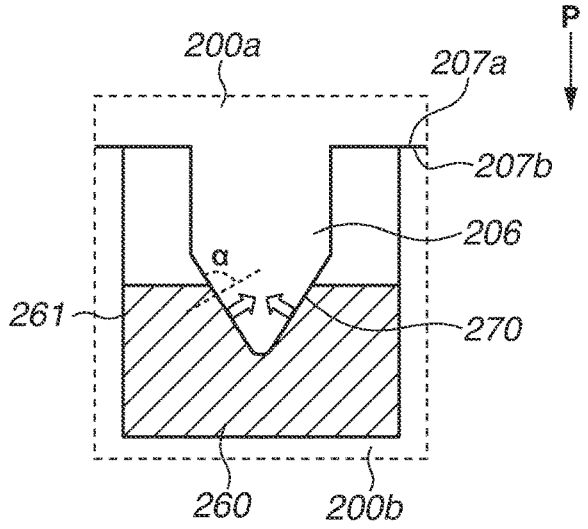
FIGS. 5A to 5C are enlarged schematic cross-sectional views of different examples of a Helmholtz member contact region according to the first embodiment.
Figure 5B:
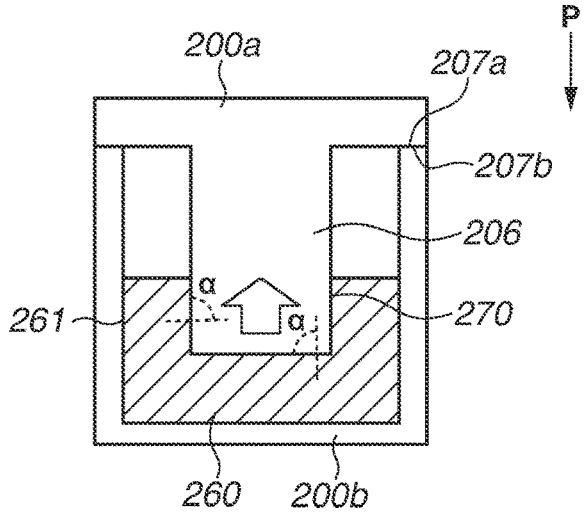
Figure 5C:
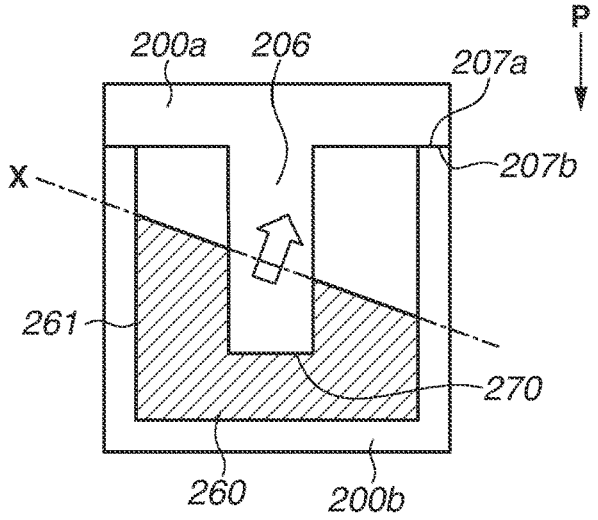

FIGS. 5A, 5B, and 5C are cross-sectional views illustrating how the sealing member 260 of the Helmholtz member 200*b* is in contact with and pushed by the pressing portion 206 as the example of the contact portion of the Helmholtz member 200*a* when the Helmholtz resonator 200 is formed. In the configuration in FIG. 5A, an angle α formed by a normal direction of a contact surface 270 and a pressing direction P is an angle of 60 degrees at a contact region of the pressing portion 206 and the sealing member 260. In other words, the contact surface 270 is not in a perpendicular direction to the pressing direction P. Including a region having the angle α of 0 degrees or more and less than 90 degrees works towards reducing a reaction force to the pressing direction from the sealing member 260 caused by being in contact and pushed than a case when the angles α are 0 degrees and 90 degrees as illustrated in FIG. 5B, The region having the angle α of 0 degrees or more and less than 90 degrees is included, and thus the sealing member 260 can be pressed without separating the abutting portions 207*a* and 207*b* of the Helmholtz members 200*a* and 200*b* if elasticity of the sealing member 260 is large. In addition, the cavity portion 201 and the communication portion 202 of the Helmholtz resonator 200 can be maintained in constant shapes, and thus a silencing target frequency can be maintained.

In the configuration in FIG. 5C, a surface of the sealing member 260 (indicated by a virtual line X) is not perpendicular to the pressing direction P of the pressing portion 206 in a state before the Helmholtz resonator 200 is formed by the Helmholtz members 200*a* and 200*b*. This configuration works towards differentiating a direction of a reaction force that the pressing portion 206 receives from the sealing member 260 from the pressing direction P.

Figure 6A:
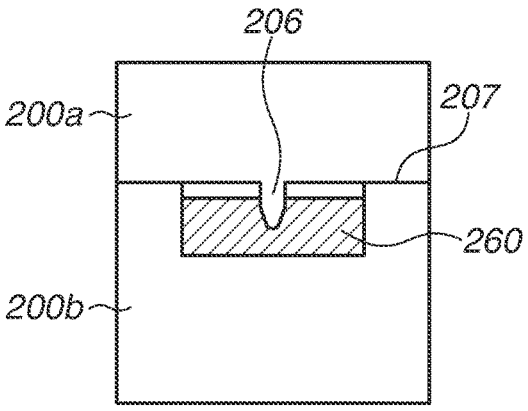
FIGS. 6A to 6D are schematic cross-sectional views of modifications of a Helmholtz pressing portion shape according to the first embodiment.
Figure 6C:
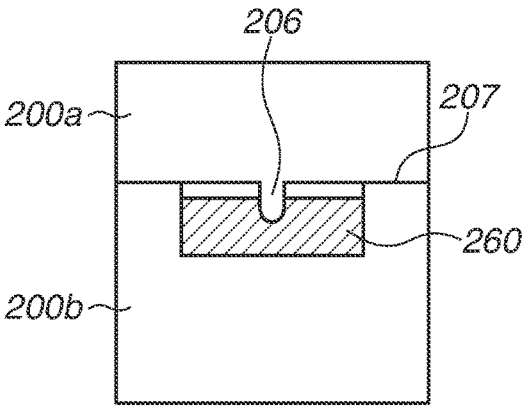
Figure 6B:
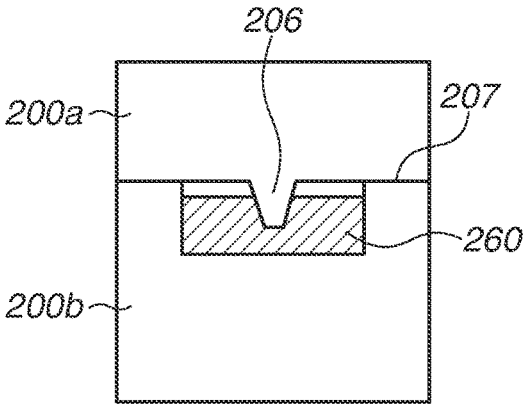
Figure 6D:
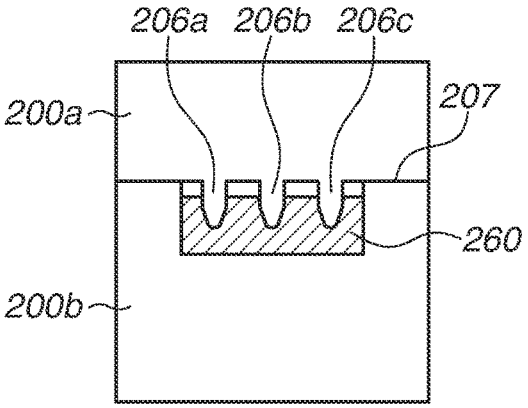
Figure 7A:
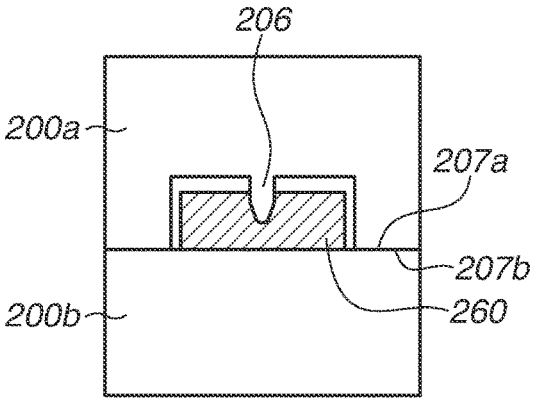
FIGS. 7A to 7D are schematic cross-sectional views of modifications of a Helmholtz abutting portion shape according to the first embodiment.
Figure 7C:
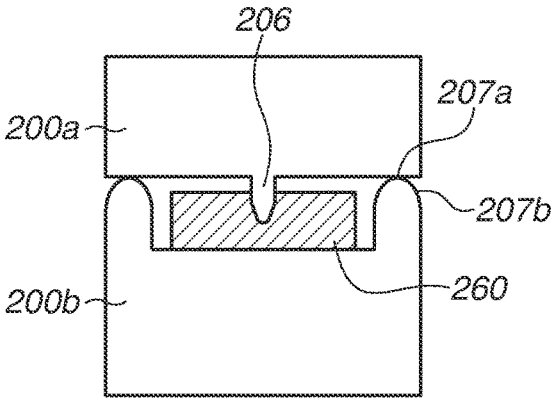
Figure 7B:
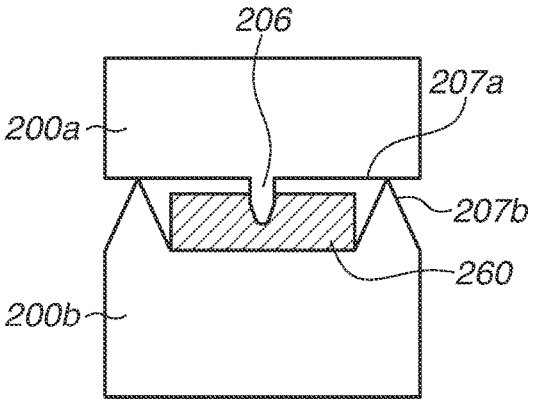
Figure 7D:
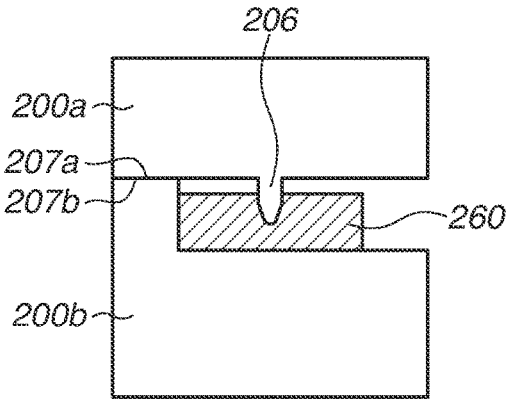

The shape of the pressing portion 206 is not limited to the above-described ones and may be a circular shape and a polygonal shape as illustrated in FIGS. 6A, 6B, and 6C, and a plurality of pressing portions 206*a*, 206*b*, and 206*c* may be included as illustrated in FIG. 6D. The shapes of the abutting portions 207*a* and 207*b* are not limited to planes and may be a shape in which a portion other than a fixing position of the sealing member 260 is formed as the abutting portion 207*b* without providing a groove on the Helmholtz member 200*b* side as illustrated in FIG. 7A. Further, the abutting portion 207*a* or 207*b* may have a polygonal shape such as a triangular shape as illustrated in FIG. 7B and a circular shape as illustrated in FIG. 7C. Furthermore, the abutting portion 207*a* or 207*b* may be provided not on both sides but on only one side of the sealing member 260 as illustrated in FIG. 7D.

Figure 8:
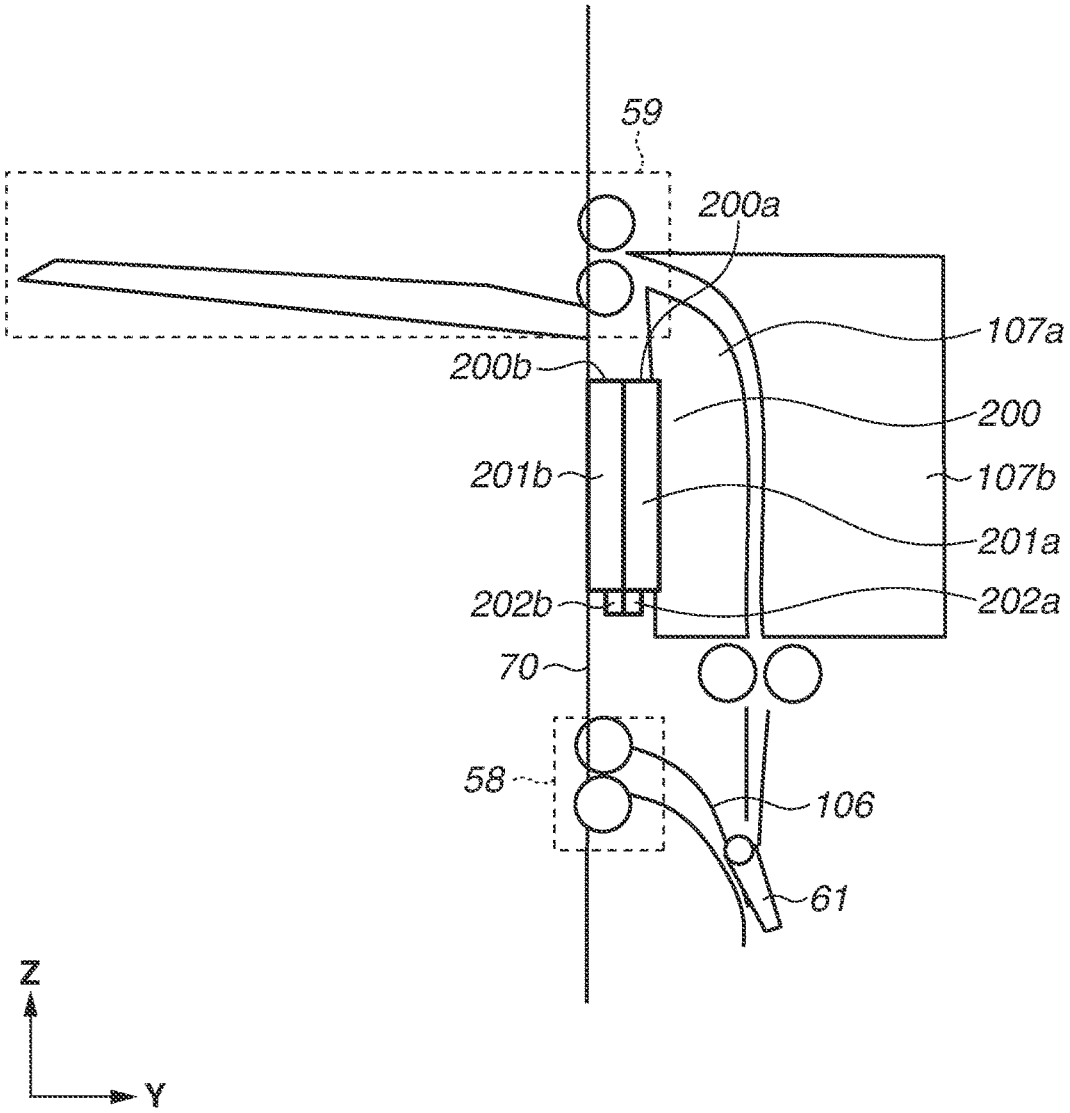
FIG. 8 is a schematic cross-sectional view near a sheet discharging unit and a sheet reversing unit according to the first embodiment.

FIG. 8 is a schematic cross-sectional view near a sheet discharging unit 58 and the sheet reversing unit 59 according to the first embodiment.

The Helmholtz member 200*a* and the Helmholtz member 200*b* are respectively fixed to a refeeding path guide 107*a* (hereinbelow, referred to as the guide 107*a*) and a refeeding guide cover 70 (hereinbelow, referred to as the guide cover 70) with an adhesive so as to bring the respective abutting portions 207*a* and 207*b* into contact with each other. The communication portions 202*a* and 202*b* face the sheet discharging unit 58 side. The attachment method of the guide 107*a* and the guide cover 70 is not limited to the above-described one, and the guide 107*a* and the guide cover 70 may be attached, for example, with a double-sided adhesive tape or by being embedded.

Figure 9A:
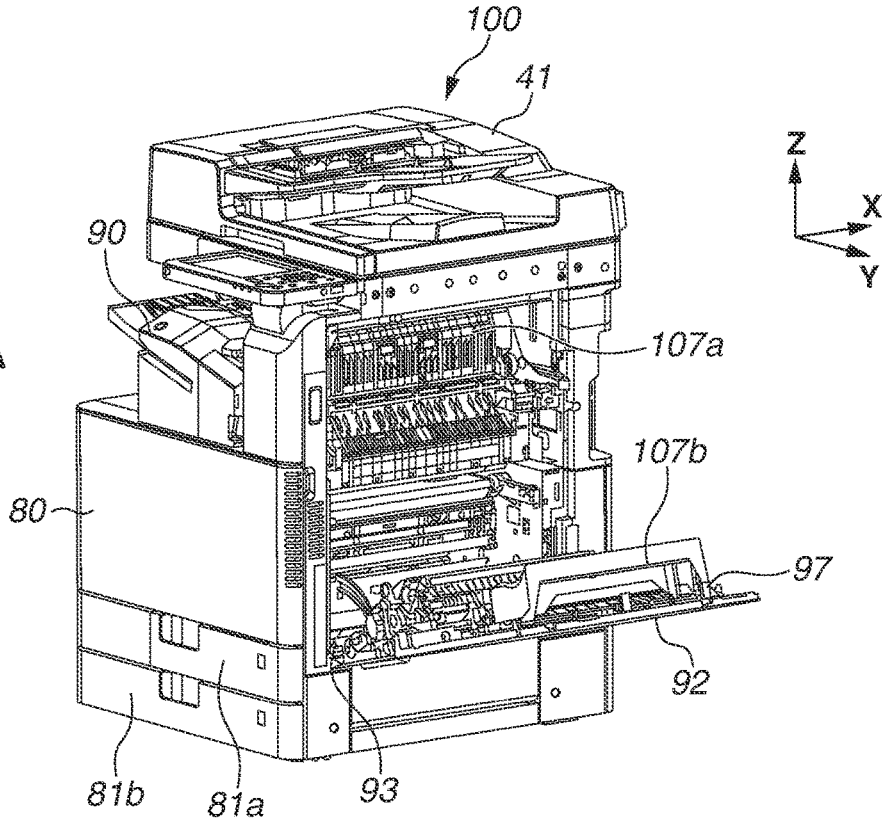
FIGS. 9A and 9B illustrate opening and closing of a portion near the sheet discharging unit and the sheet reversing unit according to the first embodiment.
Figure 9B:
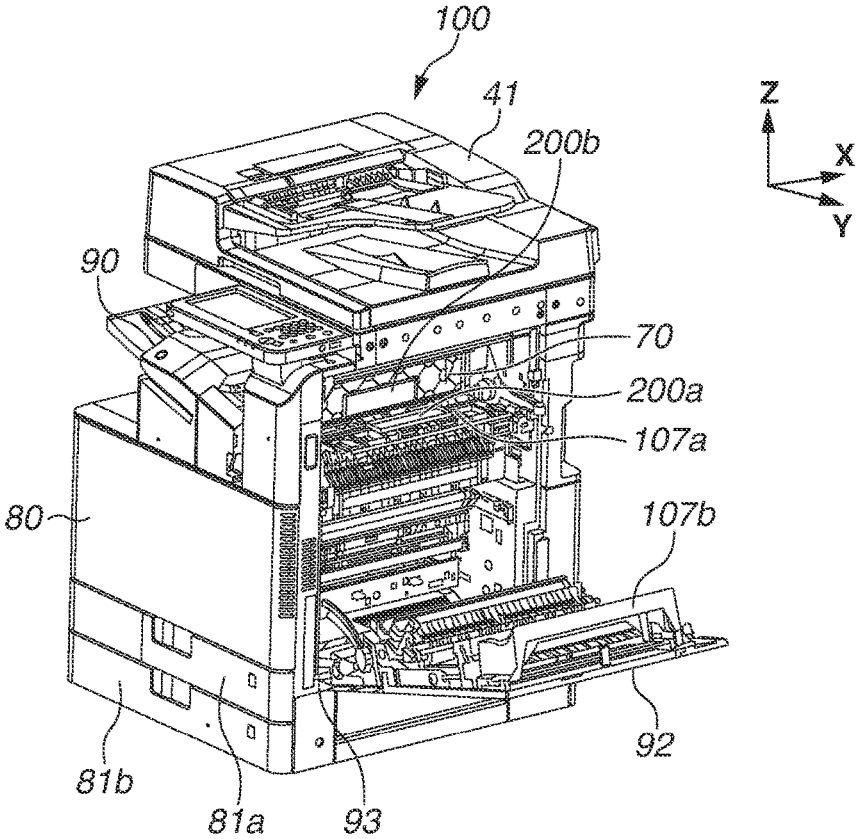

FIGS. 9A and 9B are perspective views illustrating opening and closing of a portion near the sheet discharging unit 58 and the sheet reversing unit 59 according to the first embodiment. As illustrated in FIG. 9A, a right side opening/closing door 92 can be opened and closed by a right side opening/closing door hinge portion 93 for clearing a paper jam. A refeeding path 107*b* is fixed to the right side opening/closing door 92. As illustrated in FIG. 9B, the guide 107*a* and the guide cover 70 can be also opened and closed to the same direction as the refeeding path 107*b*. The guide cover 70 can rotate centering on refeeding guide cover hinge portions 71*a* and 71*b* (see FIG. 1A) for clearing a paper jam in a recording medium post-processing unit 90. Further, when the right side opening/closing door 92 is closed, the right side opening/closing door 92 is fixed to the apparatus main body by a lock mechanism using a lock claw 97 as an example of a fixing unit, and the guide cover 70 and the guide 107*a* are also fixed in a closed state. The right side opening/closing door 92 is closed, thus the guide 107*a* is fixed to a position closed with respect to the apparatus main body 100A, and the Helmholtz resonator 200 is formed by the Helmholtz member 200*a* and the Helmholtz member 200*b* as described below, Thus, the Helmholtz resonator 200 is formed using the lock mechanism for bringing the right side opening/closing door 92 into the closed state with respect to the apparatus main body 100A. Therefore, a dedicated fastening member is not necessary to fix the Helmholtz resonator 200 including the two components.

Figure 1A:
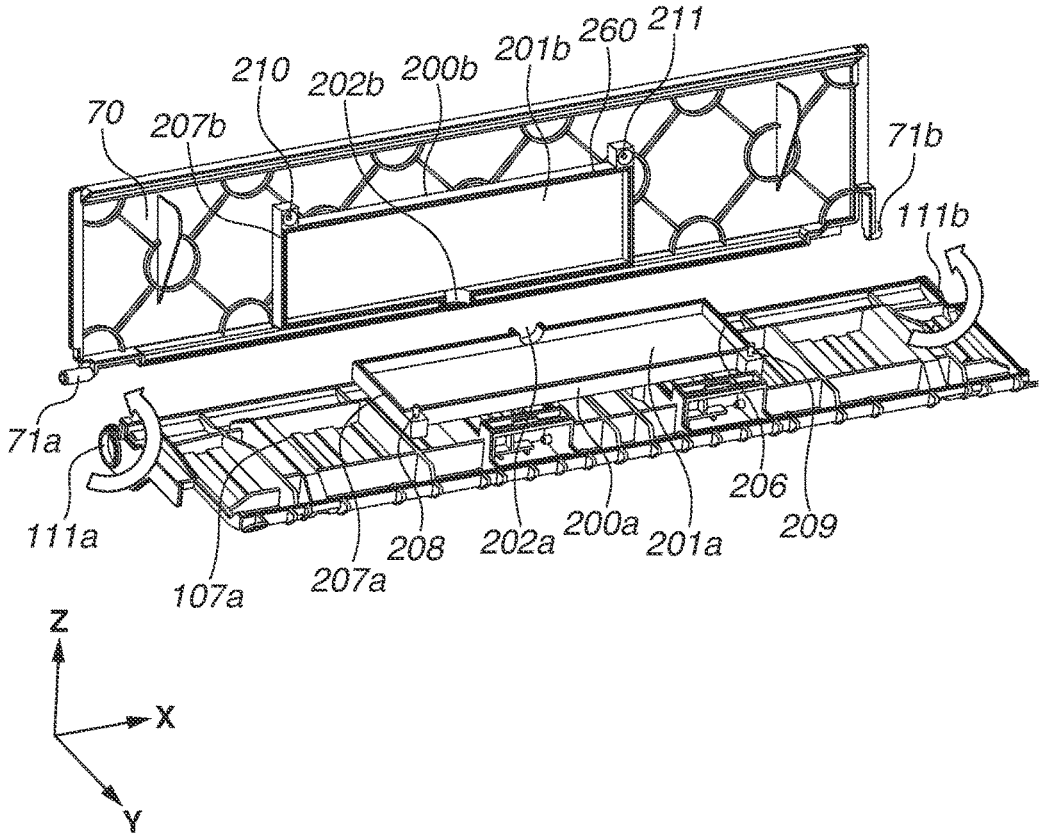
FIGS. 1A and 1B are perspective views of a Helmholtz resonator.
Figure 1B:
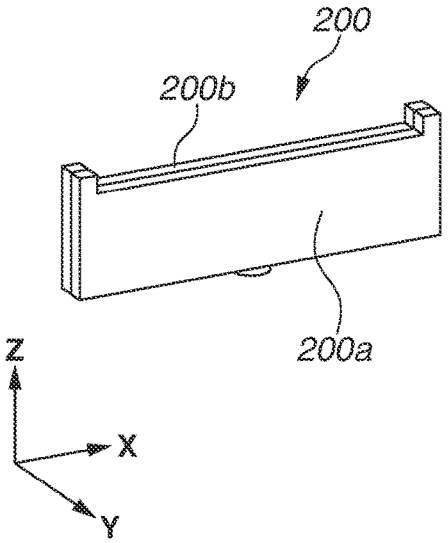
Figure 1C:
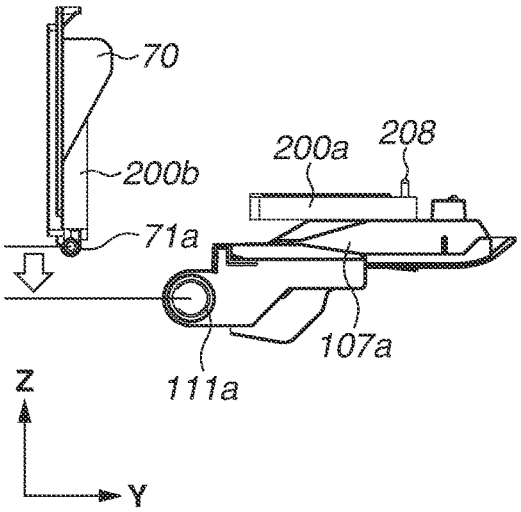
FIG. 1C is a side view of a Helmholtz resonator according to a first embodiment.
Figure 10B:
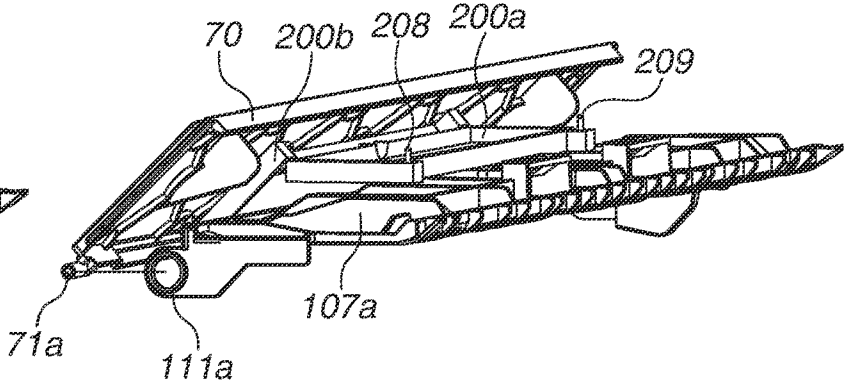
FIGS. 10A and 10B respectively illustrate a case when heights of rotating shafts of a path guide and a guide cover according to the first embodiment are different and a case when the heights are the same.
Figure 10A:
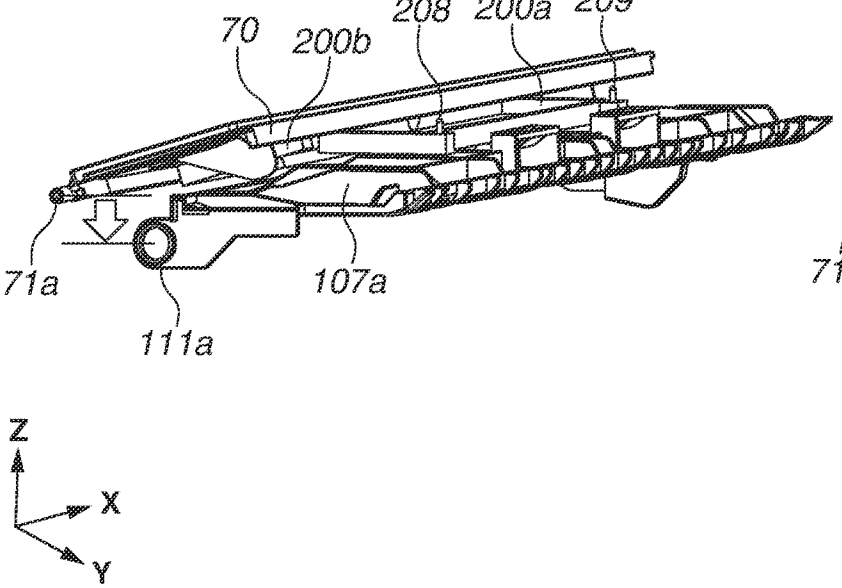
Figure 11A:
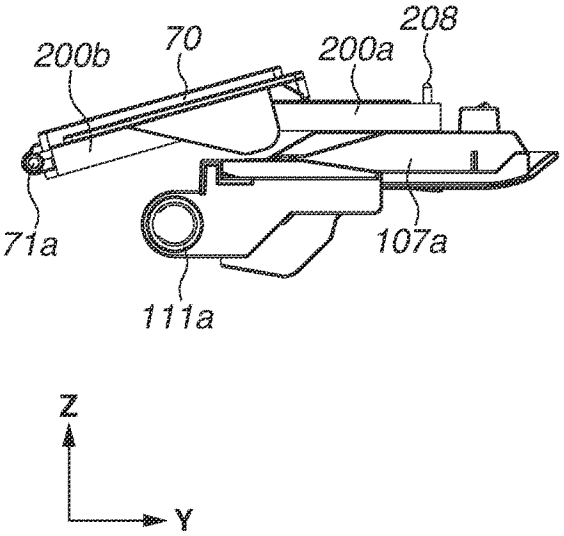
FIG. 11A illustrates a configuration in which the Helmholtz member is provided in each of the path guide and the guide cover according to the first embodiment.
Figure 11B:
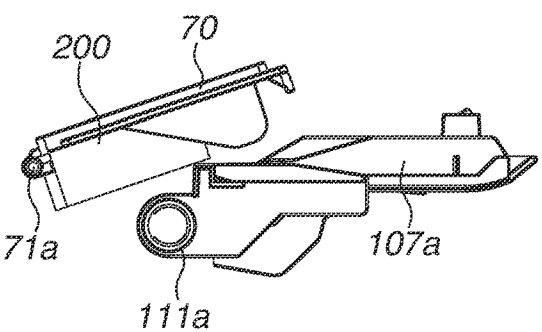
FIG. 11B illustrates a configuration in which the Helmholtz resonator is integrally fixed to the guide cover.
Figure 11C:
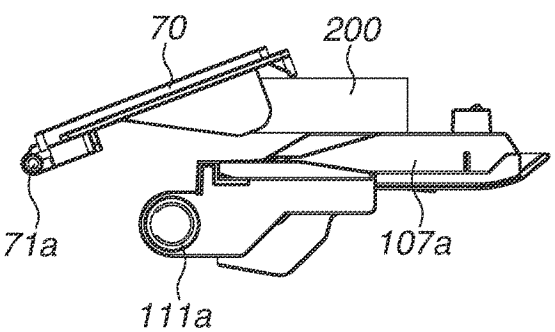
FIG. 11C illustrates a configuration in which the Helmholtz resonator is integrally fixed to the path guide.

FIG. 1A is an enlarged view of the Helmholtz members 200*a* and 200*b* and the guide cover 70 and the guide 107*a* as examples of an opening/closing member and a facing member near the Helmholtz members 200*a* and 200*b* in FIG. 9B. The guide cover 70 is opened and closed centering on the refeeding guide cover hinge portions 71*a* and 71*b*. The guide 107*a* is opened and closed centering on refeeding path hinge portions 111*a* and 111*b*. The guide cover 70 and the guide 107*a* are rotated, and a sheet conveyance path is exposed to the outside, so that a user can access the sheet conveyance path and easily remove a sheet remaining inside the apparatus main body 100A. When the guide 107*a* is closed to a direction of arrows in FIG. 1A and fixed in a state in which the guide cover 70 is closed, the Helmholtz members 200*a* and 200*b* are pressed to each other as illustrated in FIG. 1B. At that time, the left positioning portion 208 and the right positioning portion 209 are respectively inserted into the left positioning hole 210 and the right positioning hole 211, the abutting portions 207*a* and 207*b* are brought into contact with each other, and thus the Helmholtz resonator 200 is formed. FIG. 1C is a side view viewing from a left side of FIG. 1A. As illustrated in FIG. 1C, the refeeding path hinge portion 111*a* is lower than the refeeding guide cover hinge portion 71*a* in a vertical direction (a Z direction). FIGS. 10A and 10B respectively illustrate rotation of the guide cover 70 and the guide 107*a* when a height of the refeeding path hinge portion 111*a* is lower than that of the refeeding guide cover hinge portion 71*a* and when these heights are the same. When the guide cover 70 and the guides 107*a* and 107*b* are opened as in FIG. 9B, the Helmholtz member 200*a* in FIG. 10A rotates at a position lower than the Helmholtz member 200*b* that in FIG. 10B. Thus, in the configuration in FIG. 10A, the Helmholtz member 200*a* and the Helmholtz member 200*b* sufficiently rotate without interfering with each other. In the configuration in FIG. 10B, the Helmholtz member 200*a* and the Helmholtz member 200*b* interfere with each other in the middle of rotation, and thus a rotation amount of the guide cover 70 is reduced compared to the configuration in FIG. 10A. In other words, a position of the refeeding path hinge portion 111*a* is changed with respect to the refeeding guide cover hinge portion 71*a*, the rotation amount of the guide cover 70 can be increased. The Helmholtz resonator 200 is constituted of larger cavity portions 201*a* and 201*b* as a silencing target frequency is lower. If the cavity portions 201*a* and 201*b* are enlarged, the refeeding path hinge portion 111*a* is arranged on a position different from that of the refeeding guide cover hinge portion 71*a* and thus does not hinder an act of clearing a paper jam in the recording medium post-processing unit 90. FIG. 11A is a side view of the configuration of the present embodiment in which the Helmholtz resonator 200 is separated into the two components. FIG. 11B is a side view of the Helmholtz resonator 200 which is integrally provided in the guide cover 70 without being separated. FIG. 11C is a side view of the Helmholtz resonator 200 which is integrally provided in the guide 107*a* without being separated. In the configuration in FIG. 11B, the Helmholtz resonator 200 provided in the guide cover 70 interferes with the guide 107*a*, and the rotation amount of the guide cover 70 is reduced. On the other hand, the configuration in FIG. 11A does not need a space for the Helmholtz resonator 200 to rotate in a lower part compared to the configuration in FIG. 11B, and the Helmholtz resonator 200 hardly interferes with the guide 107*a*, so that the guide cover 70 can sufficiently rotate.

In the configuration in FIG. 11C, the Helmholtz resonator 200 provided in the guide 107*a* interferes with the guide cover 70, and the rotation amount of the guide cover 70 is reduced. Similarly, the configuration in FIG. 11A hardly interferes with the Helmholtz resonator 200 when the guide cover 70 rotates compared to the configuration in FIG. 11C, so that the guide cover 70 can sufficiently rotate. In other words, the Helmholtz resonator 200 is separated into the Helmholtz members 200*a* and 200*b*, the Helmholtz members 200*a* and 200*b* are respectively fixed to the guide cover 70 and the guide 107*a*, and accordingly the rotation amounts of the guide cover 70 and the guide 107*a* can be increased than when the Helmholtz resonator 200 is integrally formed and fixed thereto. Thus, clearing of a paper jam in the recording medium post-processing unit 90 becomes easier.

Figure 12A:
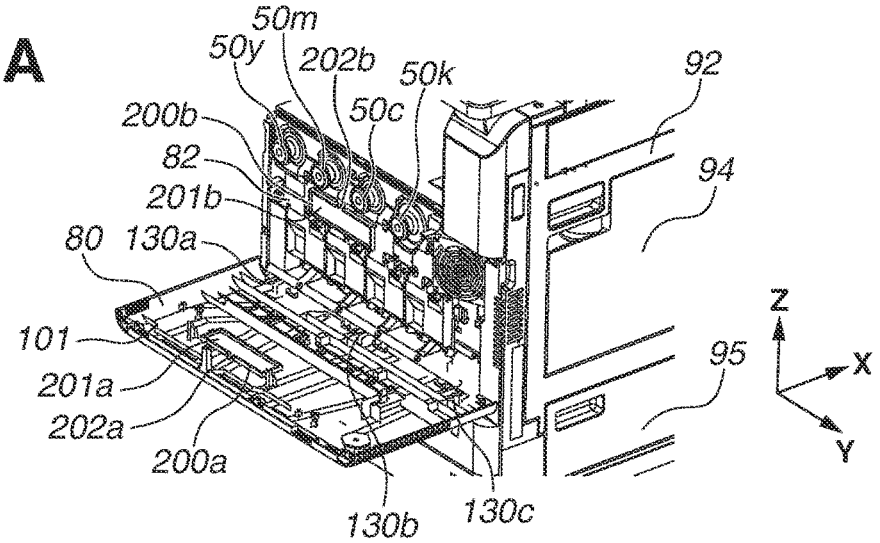
FIG. 12A is a schematic configuration view when the Helmholtz resonator is provided in a front side opening/closing cover according to the first embodiment.
Figure 12B:
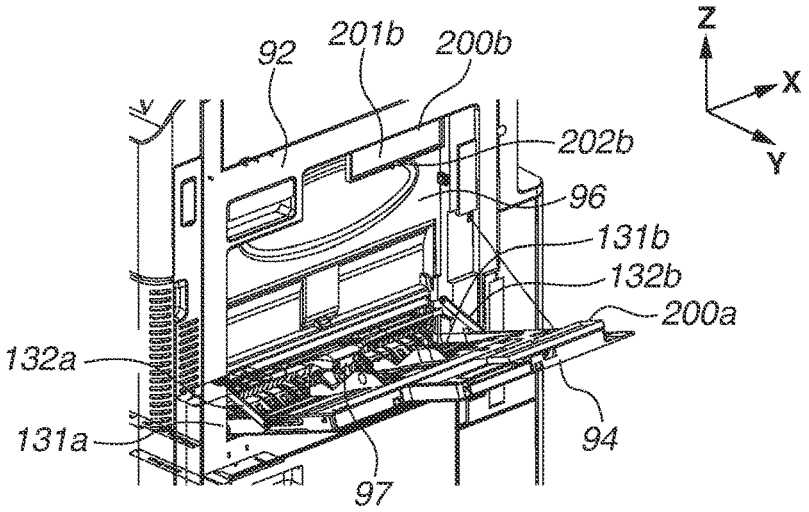
FIG. 12B is a schematic configuration view when the Helmholtz resonator is provided in a manual feed tray according to the first embodiment.
Figure 12C:
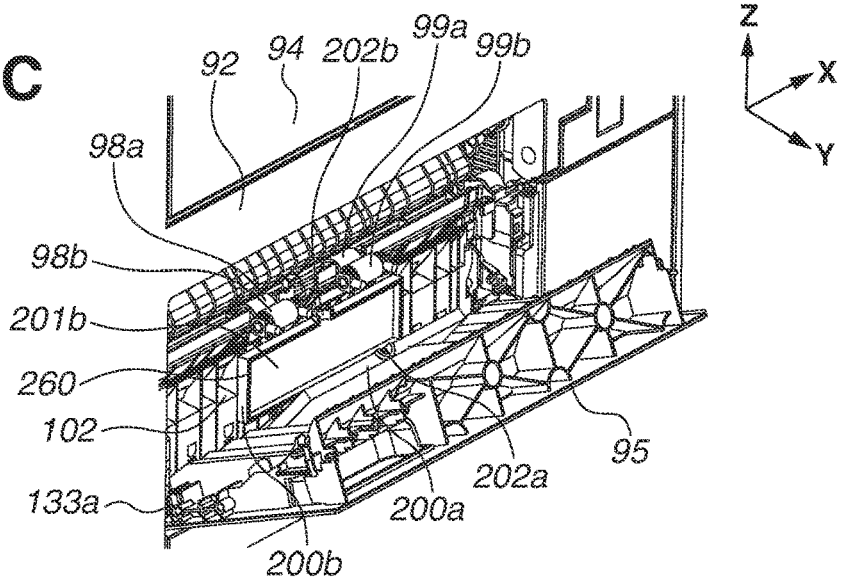
FIG. 12C is a schematic configuration view when the Helmholtz resonator is provided in a lower right side opening/closing door according to the first embodiment.

The configuration according to the present embodiment is not limited to application to an opening/closing portion near the sheet discharging unit 58 and the sheet reversing unit 59 and can be applied to any opening/closing portion unless it is not in a position inhibiting a sheet conveyance function and the like. For example, as illustrated in FIG. 12A, the configuration according to the present embodiment may be applied to an opening/closing portion of a front side opening/closing cover 80 for accessing a toner bottle 50 for supplying toner to the developing rollers 24 which are one of image forming units. In FIG. 12A, the Helmholtz member 200*b* is fixed with an adhesive to a lower position of the toner bottles 50*y*, 50*m*, 50*c*, and 50*k* of a front side inner cover 82. The Helmholtz member 200*a* is fixe with an adhesive to a position inside the front side opening/closing cover 80. When the front side opening/closing cover 80 is closed with respect to the apparatus main body using front side opening/closing cover hinge portions 130*a*, 130*b*, and 130*c* as rotation centers and locked by a lock portion 101, the Helmholtz member 200*a* and the Helmholtz member 200*b* are combined and form the Helmholtz resonator 200. In addition, as illustrated in FIG. 12B, the configuration according to the present embodiment may be applied to an opening/closing portion of a manual feed tray 94. In FIG. 12B, the Helmholtz member 200*b* is fixed with an adhesive to a right side inner cover 96. The manual feed tray 94 is opened and closed centering on manual feed tray hinge portions 131*a* and 131*b* and fixed on an opened position by hooks 132*a* and 132*b* when being opened. The Helmholtz member 200*a* is fixed with an adhesive to a position inside the manual feed tray 94 so as to form the Helmholtz resonator 200 by combining with the Helmholtz member 200*b* the manual feed tray 94 is closed. When the manual feed tray 94 is fixed at a position closed with respect to the apparatus main body by a lock member, not illustrated, the Helmholtz member 200*a* and the Helmholtz member 200*b* are combined and can form the Helmholtz resonator 200. Further, as illustrated in FIG. 12C, the configuration according to the present embodiment may be applied to an opening/closing portion of a lower right side opening/closing door 95 in a lower part of the manual feed tray 94. In FIG. 12C, the Helmholtz member 200*b* is fixed with an adhesive to a lower part of sheet feeding/drawing rollers 98*a*, 98*b*, 99*a*, and 99*b* of a lower right side inner cover 102 as a position not inhibiting the sheet conveyance function. The lower right side opening/closing door 95 is opened and closed centering on a lower right side opening/closing door hinge portion 133*a* and a lower right side opening/closing door hinge portion 133*b*, not illustrated. The Helmholtz member 200*a* is fixed with an adhesive to a position inside the lower right side opening/closing door 95 so as to form the Helmholtz resonator 200 by combining with the Helmholtz member 200*b* when the lower right side opening/closing door 95 is closed. When the lower right side opening/closing door 95 is fixed at a position closed with respect to the apparatus main body by a lock member, not illustrated, the Helmholtz member 200*a* and the Helmholtz member 200*b* are combined and can form the Helmholtz resonator 200.

The configuration according to the present embodiment can form the Helmholtz resonator 200 without using a fastening member dedicated to the Helmholtz resonator unlike the conventional technique and can suppress a noise generated from the image forming apparatus without increasing costs.

Next, a second embodiment of the present disclosure is described with reference to FIG. 13. According to the second embodiment, different parts from the above-described first embodiment are only described, the same elements are denoted by the same reference numerals, and their descriptions are omitted.

Figure 13:
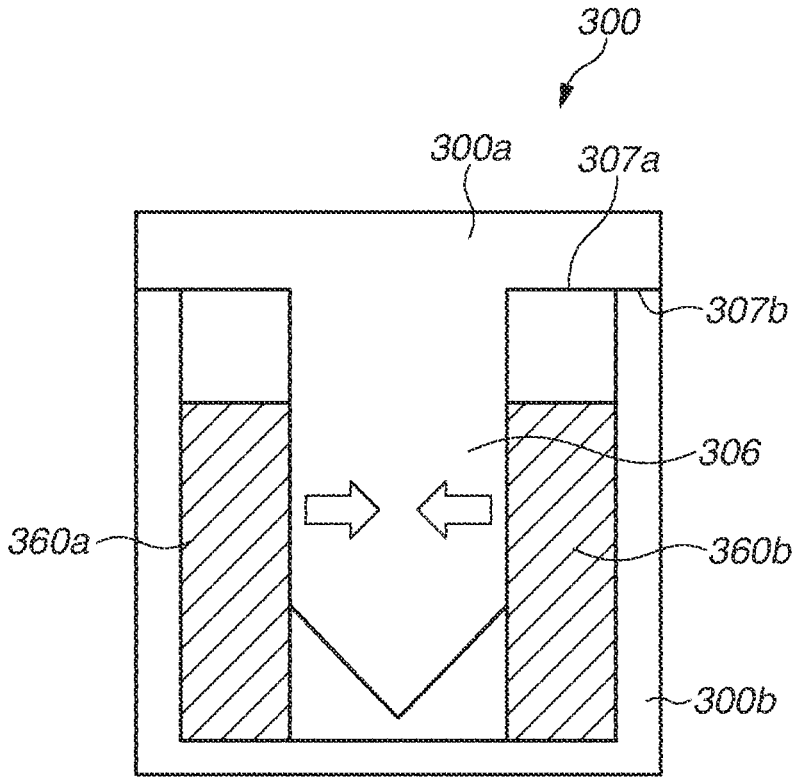
FIG. 13 is a schematic cross-sectional view of a Helmholtz member contact region according to a second embodiment

FIG. 13 illustrates an example of a Helmholtz resonator 300 according to the present embodiment. The Helmholtz resonator 300 includes two components, namely a Helmholtz member 300*a* as an example of a first Helmholtz portion and a Helmholtz member 300*b* as an example of a second Helmholtz portion.

The second embodiment is different from the first embodiment in a configuration of sealing members 360*a* and 360*b*. In a contact region of the Helmholtz members 300*a* and 300*b* when forming the Helmholtz resonator 300, the sealing members 360*a* and 360*b* are separated, and a pressing portion 306 is inserted into a gap therebetween. Accordingly, a force acts on the inserted pressing portion 306 to be nipped by the sealing members 360*a* and 360*b*, and the pressing portion 306 once pressed hardly comes off by a frictional force acting between the sealing members 360*a* and 360*b*. Abutting portions 307*a* and 307*b* in FIG. 13 are not limited to them, and a contact position to the Helmholtz member 300*b* may be regarded as an abutting portion by regarding the pressing portion 306 itself as the abutting portion 307*a*. Thus, according to the Helmholtz resonator 300 of the present embodiment, once the Helmholtz resonator 300 is formed, a volume of a cavity portion 301 is hardly changed, and a specific frequency as a silencing target can be prevented from being deviated.

Next, a third embodiment of the present disclosure is described, According to the third embodiment, different parts from the above-described first and second embodiments are only described, the same elements are denoted by the same reference numerals, and their descriptions are omitted.

Figure 14B:
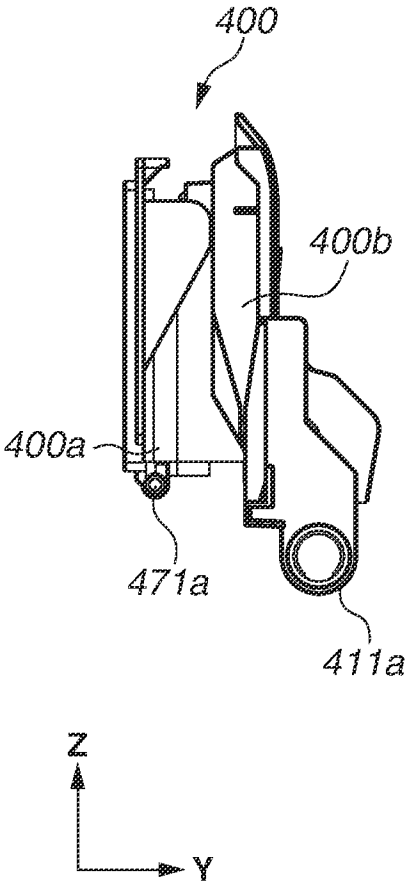
FIGS. 14A and 14B are respectively a perspective view and a side view of a Helmholtz resonator according to a third embodiment.
Figure 14A:
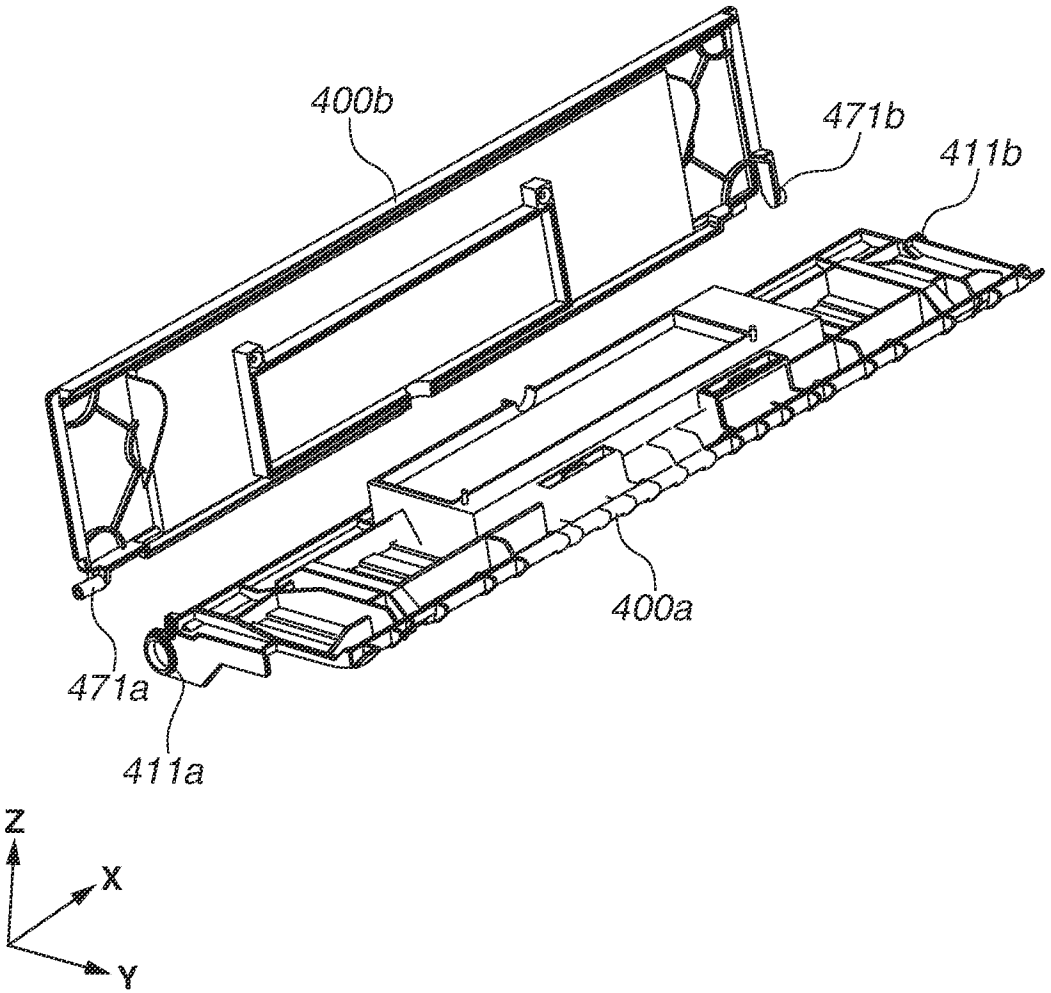

FIGS. 14A and 14B illustrate examples of a Helmholtz resonator 400 according to the present embodiment. The Helmholtz resonator 400 includes two components, namely a Helmholtz member 400*a* as an example of a first Helmholtz portion and a Helmholtz member 400*b* as an example of a second Helmholtz portion.

A difference from the Helmholtz resonators 200 and 300 according to the above-described first and second embodiments is that the Helmholtz members 400*a* and 400*b* are not fixed with an adhesive to but integrally formed on a mounting resin member such as an opening/closing member. The Helmholtz resonator 400 according to the present embodiment can be formed by reducing the number of components without separately manufacturing the Helmholtz members 400*a* and 400*b* and can suppress a noise generated from the image forming apparatus without increasing costs.

The present disclosure is not limited to the configurations of the Helmholtz resonators (communication portion shapes, cavity portion shapes, and the like) according to the above-described embodiments. The Helmholtz resonators according to the above-described first to third embodiments are described using examples when the communication portions are cylindrical hollow tubes, however, the present disclosure is not limited to the cylindrical hollow tube. A hollow tube having another sectional shape may be used and produce a similar effect. In addition, the Helmholtz resonators according to the above-described embodiments are described using examples when cavity portions have cuboid shell shapes which include holes in their parts. However, the present disclosure is not limited to the cuboid shell shapes. A cavity portion having another shape may be used and produce a similar effect. Further, examples in which at least one of the two components constituting the Helmholtz resonator is provided in a rotation member are described, however, the present disclosure is not limited to these examples. At least one of the two components constituting the Helmholtz resonator may be provided in a unit such as a door which slidingly moves, and the Helmholtz resonator may be formed when the unit is closed with respect to the apparatus main body.

While the present disclosure has been described with reference to embodiments, it is to be understood that the disclosure is not limited to the disclosed embodiments. The scope of the following claims is to be accorded the broadest interpretation so as to encompass all such modifications and equivalent structures and functions.

This application claims the benefit of Japanese Patent Application No. 2017-214158, filed Nov. 6, 2017, which is hereby incorporated by reference herein in its entirety.

What is claimed is:

1. An image forming apparatus comprising:

a conveyance path configured to convey a sheet;

an image forming unit configured to form an image on a sheet conveyed along the conveyance path;

an opening/closing member configured to be openable and closable with respect to an apparatus main body, wherein a part of the conveyance path is exposed in a case where the opening/closing member is opened;

a facing member, wherein, in a case where the opening/closing member is closed with respect to the apparatus main body, the facing member is provided on a position facing the opening/closing member;

a first member including a first abutting portion and provided in the opening/closing member; and a second member including a second abutting portion and provided in the facing member, wherein, in a case where the opening/closing member is closed by a fixing member with respect to the apparatus main body, the first abutting portion and the second abutting portion abut on each other and form a Helmholtz resonator.

2. The image forming apparatus according to claim 1, further comprising a fixing unit configured to fix the opening/closing member to a position closed with respect to the apparatus main body.

3. An image forming apparatus comprising:

a conveyance path configured to convey a sheet;

an image forming unit configured to form an image on a sheet conveyed along the conveyance path;

an opening/closing member configured to be openable and closable with respect to an apparatus main body, wherein a part of the conveyance path is exposed in a case where the opening/closing member is opened;

a facing member, wherein, in a case where the opening/closing member is closed with respect to the apparatus main body, the facing member is provided on a position facing the opening/closing member;

a first member provided in the opening/closing member; and a second member provided in the facing member, wherein, in a case where the opening/closing member is closed by a fixing member with respect to the apparatus main body, the first member and the second member form a Helmholtz resonator, and wherein, in a case where the Helmholtz resonator is formed, a positioning portion configured to determine positions of the first member and the second member is included in at least either of the opening/closing member and the facing member.

4. The image forming apparatus according to claim 1, wherein, in a case where the Helmholtz resonator is formed, one of the first member and the second member includes a sealing member configured to seal the first and the second members, and another one of the first member and the second member includes a contact portion configured to be in contact with the sealing member.

5. The image forming apparatus according to claim 4, wherein, in a case where the first member and the second member form the Helmholtz resonator, a contact surface of the sealing member and the contact portion is not perpendicular to a pressing direction of the contact portion.

6. The image forming apparatus according to claim 4, wherein, in a case where the first member and the second member form the Helmholtz resonator, at least a portion in which an angle $\alpha$, formed by a contact surface of the sealing member and the contact portion and a pressing direction of the contact portion, is 0 degrees $<X<90$ degrees is included.

7. The image forming apparatus according to claim 4, wherein a surface of the sealing member is not perpendicular to a pressing direction of the contact portion in a state before the first member and the second member form the Helmholtz resonator.

8. The image forming apparatus according to claim 1, wherein a neck portion of the first member and a neck portion of the second member are divided to be respectively semicylinders.

9. An image forming apparatus comprising:

a conveyance path configured to convey a sheet;

an image forming unit configured to form an image on a sheet conveyed along the conveyance path;

an opening/closing member configured to be openable and closable with respect to an apparatus main body, wherein a part of the conveyance path is exposed in a case where the opening/closing member is opened;

a facing member provided rotatably centering on a rotation center, wherein, in a case where the opening/closing member is closed with respect to the apparatus main body, the facing member is provided on a position facing the opening/closing member;

a first member provided in the opening/closing member; and a second member provided in the facing member, wherein, in a case where the opening/closing member is closed by a fixing member with respect to the apparatus main body, the first member and the second member form a Helmholtz resonator.

10. The image forming apparatus according to claim 9, wherein a rotation center of the opening/closing member is arranged on a position that is different from a position on which a rotation center of the facing member in a direction perpendicular to the rotation center of the opening/closing member is arranged.

* * * * *